US006953366B2

(12) United States Patent
Fukatsu et al.

(10) Patent No.: US 6,953,366 B2
(45) Date of Patent: Oct. 11, 2005

(54) CONNECTOR

(75) Inventors: Yukihiro Fukatsu, Yokkaichi (JP); Toshikazu Sakurai, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 10/972,932

(22) Filed: Oct. 25, 2004

(65) Prior Publication Data

US 2005/0090149 A1 Apr. 28, 2005

(30) Foreign Application Priority Data

Oct. 28, 2003 (JP) ..... 2003-367865

(51) Int. Cl.[7] ..... H01R 13/40
(52) U.S. Cl. ..... 439/595; 439/752
(58) Field of Search ..... 439/595, 752, 439/751, 744, 745, 488

(56) References Cited

U.S. PATENT DOCUMENTS 6,193,551 B1 * 2/2001 Yamamoto et al. ..... 439/595
6,276,964 B1 * 8/2001 Shinozaki ..... 439/595
2001/0002347 A1 * 5/2001 Yoshida et al. ..... 439/595
2002/0127914 A1 * 9/2002 Yamamoto ..... 439/595
2002/0151215 A1 * 10/2002 Yamanashi et al. ..... 439/595

FOREIGN PATENT DOCUMENTS

JP 6-325814 11/1994

* cited by examiner

*Primary Examiner*—Hien Vu
(74) *Attorney, Agent, or Firm*—Gerald E. Hespos; Anthony J. Casella

(57) ABSTRACT

A female housing (20) has cavities (21) for receiving female terminal fittings (10) and locks (27) for locking the female terminal fittings (10). Each lock (27) is deformed resiliently in the process of inserting the female terminal fitting (10), and is restored resiliently to lock the female terminal fitting (10) when the female terminal fitting (10) is inserted to a proper depth. A reinforcement (36) bulges out on a lower surface (31) of the lock (27) toward the deformation space (S) from a phantom line (L) connecting a front bending point (31*b*), which is a leading end position of the lock (27) with respect to a deforming direction when the lock (27) is deformed maximally, and a deformation supporting position (31*c*).

13 Claims, 6 Drawing Sheets

CONNECTOR

BACKGROUND OF THE INVENTION

1. Field of the Invention

The invention relates to a connector with a locking portion.

2. Description of the Related Art

Japanese Unexamined Patent Publication No. H06-325814discloses a connector with a lock for locking a terminal fitting. This connector has a housing with cavities into which terminal fittings are insertable. Resiliently deformable locks are formed in the housing and deform in the process of inserting the terminal fittings. However, the locks are restored resiliently to lock the terminal fittings when the terminal fittings reach a proper depth.

The connector can be miniaturized by decreasing the size of each cavity. However, the width and thickness of the locks become smaller as the cavities are made smaller. Thinner locks may buckle when the terminal fittings are pulled in their locked state. The strength of the lock against buckling is proportional to a sectional area obtained by cutting the lock normal to the longitudinal direction thereof. The lock may be thickened to improve the buckling strength, but this leads to a larger connector. This problem could not be solved easily.

The invention was developed in view of the above problem and an object thereof is to strengthen a lock without substantial enlargement.

SUMMARY OF THE INVENTION

The invention relates to a connector with a housing that has at least one cavity and at least one terminal fitting inserted into the cavity. A resilient lock is provided in each cavity for locking the terminal fitting therein. The lock is deformed temporarily as the terminal fitting is inserted into the cavity. However, the lock is restored resiliently to lock the terminal fitting when the terminal fitting reaches a proper depth. A reinforcement bulges towards a deformation space from a line that connects a leading end of the lock with a deformation support when the lock is deformed maximally. A deformation support is provided on a surface of the lock facing the deformation space.

The lock engages the terminal fitting and resists pulling forces that could pull the terminal fitting out of the cavity. The strength of the lock against buckling is proportional to a sectional area obtained by cutting the lock substantially normal to the longitudinal direction of the lock. According to the invention, the sectional area is increased by the reinforcement. As a result, the buckling strength of the lock is enhanced. Further, the reinforcement bulges towards the deformation space from the phantom line connecting the leading end of the lock and the deformation support. Thus, the reinforcement takes advantage of a dead space, and does not enlarge the connector.

The reinforcement preferably is thickest at a buckling expected position of the lock. Thus, the buckling strength is enhanced further.

A sectional area of the lock in a direction normal to the longitudinal direction thereof preferably is maximal at or near a bending point of the lock.

The lock preferably is wider at the base of the lock than at a projecting end thereof.

The base of the lock preferably is as wide as or slightly wider than the cavity and the projection preferably is slightly narrower than the cavity.

The lock preferably is cantilevered.

The lock preferably has a protrusion-insertion groove for receiving a protrusion of the terminal fitting as the terminal fitting s inserted into the cavity.

The bulge preferably bulges in near the deformation support of the lock or at the protrusion-insertion groove, thereby reinforcing the lock.

A wall of the housing preferably is engageable with a surface of the lock before the lock is deformed beyond its resiliency limit thereby preventing excessive resilient deformation of the lock.

The housing preferably comprises at least one mold-removal hole that opens in forward in a position in front of the lock.

The lock comprises a front surface extending from the leading end. The front surface preferably does not contact a wall of the housing even when the lock is deformed maximally. Thus, a specified clearance is defined between the front surface and the wall.

These and other objects, features and advantages of the invention will become more apparent upon reading of the following detailed description of preferred embodiments and accompanying drawings. It should be understood that even though embodiments are described separately, single features thereof may be combined to additional embodiments.

DETAILED DESCRIPTION OF THE PREFERRED EMBODIMENTS

Figure 1:
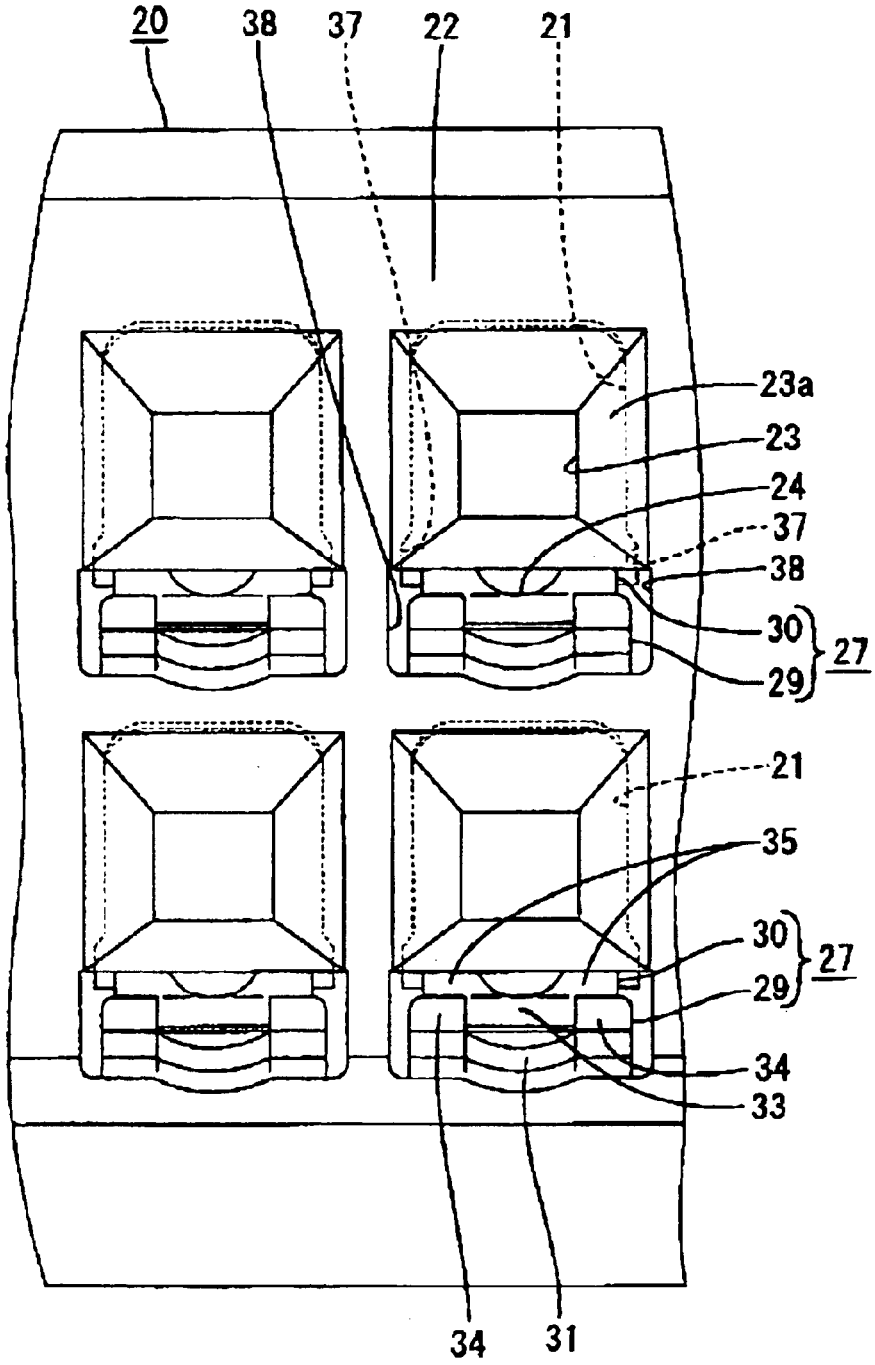
FIG. 1 is a front view of a female housing according to one embodiment of the invention.

A connector assembly according to the invention is described with reference to FIGS. 1 to 6. The connector assembly includes a female connector that has female terminal fittings 10 inserted into a female housing 20. The female terminal fittings 10 are electrically connectable with male terminal fittings accommodated in a mating male housing (neither male housing nor male terminal fittings are shown) when the male housing is connected with the female housing 20. In the following description, the inserting and withdrawing directions IWD of the female terminal fittings 10 into and from the female housing 20 are referred to as forward and backward directions, respectively, and reference is made to the respective drawings concerning vertical direction. However, the terms vertical, up and down are used herein as a convenient frame of reference, and do not imply a required gravitational orientation The female terminal fitting 10 is formed, for example, by bending, folding and/or embossing a metal plate stamped out or cut into a specified development. More particularly, as shown in FIG. 2, the female terminal fitting 10 has a rectangular tubular main portion 11 and a barrel 12 coupled one after the other. The main portion 11 is electrically connectable with a tab (not shown) of the mating male terminal fitting. The barrel 12 is configured to be crimped, bent or folded into connection with an end of a wire W. The barrel portion 12 includes two front crimping pieces and two rear crimping pieces. The front crimping pieces are to be crimped, bent or folded into connection with a core of the wire W, whereas the rear crimping pieces are to be crimped, bent or folded into an insulation coating of the wire W.

A recess 13 is formed substantially in the longitudinal middle of the bottom surface of the main portion 11 and a widthwise intermediate portion of the front edge of the recess 13 is embossed to form a downwardly and outwardly projecting a locking protrusion 14. A protrusion 15 projects to substantially the same position as the locking protrusion 14 at the rear end of the bottom surface of the main portion 11. A stabilizer 16 projects down beyond the protrusion 15 at a position immediately before the protrusion 15. The stabilizer 16 stabilizes the insertion of the female terminal fitting 10 and prevents an upside-down insertion of the female terminal fitting 10.

Figure 2:
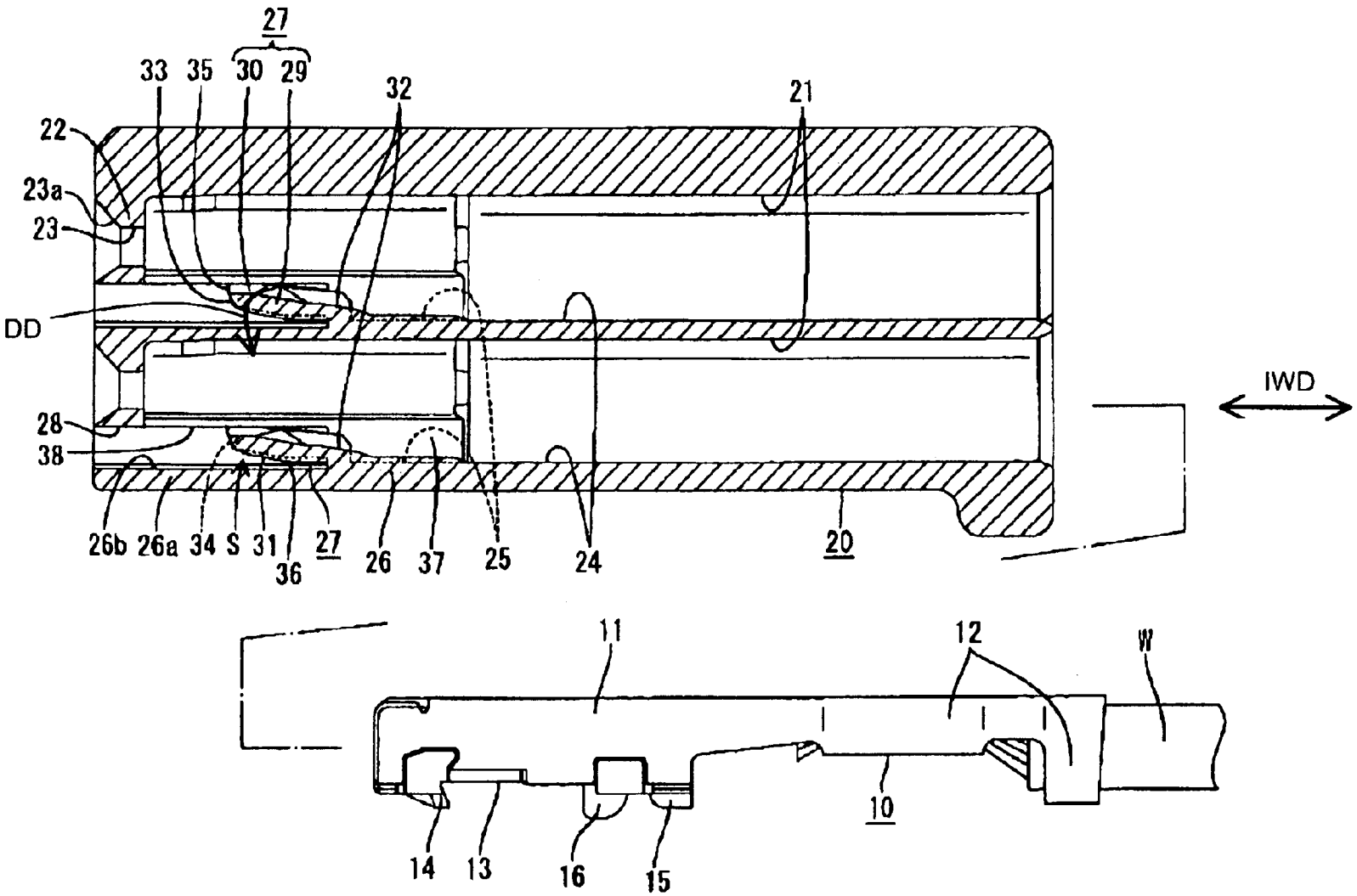
FIG. 2 is a side view in section showing a state before female terminal fittings are inserted into the female housing.

Cavities 21 are arranged side by side along a widthwise direction of the housing 20 at upper and lower stages, as shown in FIGS. 1 and 2, and are configured for receiving the female terminal fittings 10. The inserted female terminal fitting 10 is stopped at a front-end position by contacting a front wall 22 of the cavity 21. The front wall 22 has a tab insertion hole 23 for permitting insertion of a tab of a mating male terminal fitting. A substantially conically converging guiding surface 23*a* is formed around the front edge of this tab insertion hole 23 for guiding the insertion of the tab.

A protrusion-insertion groove 24 is formed in a widthwise intermediate portion of the bottom surface of the cavity 21 for receiving the locking protrusion 14 and the protrusion 15 of the female terminal fitting 10. A stabilizer-insertion groove 25 is formed in the bottom surface of the cavity 21 at a side of the protrusion-insertion groove 25 towards a depth direction of FIG. 2 for receiving the stabilizer 16 of the female terminal fitting 10. The protrusion-insertion groove 24 is substantially continuous with the lock 27, whereas the front end of the stabilizer-insertion groove 25 is slightly behind the deformation support 31*c* at the base end of the lock 27.

About a front quarter of the bottom wall 26 of the cavity 21 is lowered slightly, and the lock 27 cantilevers forward from a step formed by lowering the bottom wall 26. The lock 27 is sloped gradually up and in towards the front end, and hence bulges into the cavity 21. The lock 27 is pressed by the female terminal fitting 10 and deforms resiliently down and out in a deforming direction DD that intersects the inserting and withdrawing directions IWD of the female terminal fitting 10. The deformation support 31*c* at the base end of the lock 27 is a supporting point for the deformation. The lock 27 retracts during this resilient deformation and enters a deformation space S between the lock 27 and a recess 26*a* of the bottom wall 26. The locking protrusion 14 of the female terminal fitting 10 can enter a space before the lock 27. The recess 26*a* of the bottom wall 26 substantially faces the lock 27 with the deformation space S therebetween and engages a lower surface 31 of the lock 27 before the lock 27 is deformed beyond its resiliency limit. Thus, excessive deformation of the lock 27 is prevented. A forwardly open mold-removal hole 28 is formed in the front wall 22 of the cavity 21 below the tab insertion hole 21 because a forming mold for forming the frontal shape of the lock 27 is removed forward during molding the female housing 20. The mold-removal hole 18 does not communicate with the tab insertion hole 23. The lock 27 is substantially covered over the entire width by the recessed portion 26*a* of the bottom wall 26 coupled to the front wall 22 while being substantially exposed to the cavity 21 below and to the outside, thereby being substantially protected.

Figure 3:
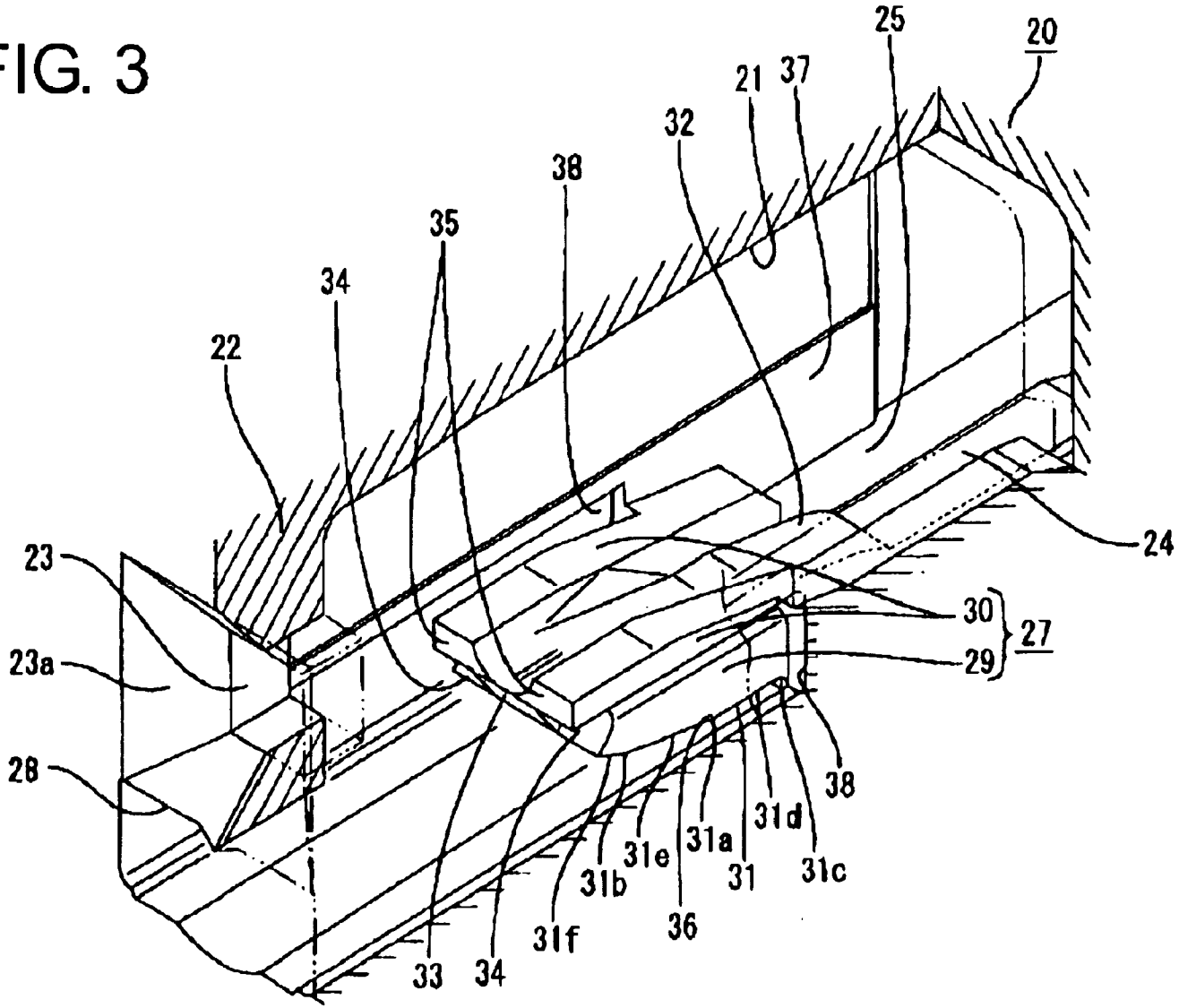
FIG. 3 is a perspective view partly in section of the female housing.

As shown in FIG. 3, the lock 27 has a base 29 and a projection 30. The base 29 is substantially in the form of an arm supported at one end and extending forward substantially along the inserting and withdrawal directions IWD from the step of the bottom wall 26. The projection 30 projects into the cavity 21 from the upper surface of the base 29. The upper surface of the base 29 is at substantially the same height as the bottom surface of the cavity 21. A projecting distance of the projection 30 into the cavity 21 is substantially equal to the depth of the recess 13 of the female terminal fitting 10. The upper surface of the base 29 extends substantially horizontally along the inserting and withdrawal directions IWD, whereas the lower surface thereof is inclined up and in towards the front as a whole. Thus, the base 29 is thicker at the root or rear end than at the leading end or at the projection 30. On the other hand, the projection 30 has a rear part of its upper surface sloped up and in toward the front and a front part that is substantially horizontal along the inserting and withdrawal directions IWD. Thus, a rear part of the projection 30 becomes gradually thicker towards the front, whereas a front part thereof has a substantially constant thickness. The upper surface of the lock 27 is recessed substantially in the widthwise center over substantially the entire length by the protrusion-insertion groove 24. A rear part of the protrusion-insertion groove 24 gradually narrows towards the front while at least a front portion has an arcuate cross section. The projection 30 is divided into left and a right sections over substantially the entire length by the protrusion-insertion groove 24, whereas the base 29 has its rear part cut obliquely cut to a specified depth. A bulge 32 bulges up and in at the deformation support 31*c* of the lock 27 on the bottom surface of the protrusion-insertion groove 24, thereby reinforcing the lock 27.

A locking surface 33 is formed on a widthwise intermediate portion at the front of the base 29 and slants up and in towards the front. The locking surface 33 is engageable with the rear end surface of the locking protrusion 14 of the female terminal fitting 10. The locking surface 33 is inclined with respect to the inserting and withdrawal directions IWD to extend substantially along the rear end surface of the locking protrusion 14. Two maneuverable recesses 34 are formed at substantially opposite widthwise sides of the front surface of the base 29 at positions adjacent to the locking surface 33 along widthwise direction and are maneuverable by a jig 40 for forcibly resiliently deforming the lock 27 in the deforming direction DD. Both maneuverable recesses 34 are displaced from the locking protrusion 14 along widthwise direction to be exposed to the outside in front even if the female terminal fitting 10 is engaged with the lock 27. Thus, the jig 40 can be insertable from front. The jig 40 has a grip 41 that can be held by an operator. Two operating portions 42 project forward from the grip 41 and can be inserted into the respective maneuverable recesses 34 (see FIG. 6). The upper or inner surfaces of the maneuverable recesses 34 are substantially horizontal and substantially parallel to the inserting and withdrawal directions IWD. However, the bottom surfaces of the maneuverable recesses 34 slope up and back, and are engageable by the jig 40. A locking surface 35 is defined at the front of the projection 30 and is substantially continuous with the locking surface 33. The locking surface 35 is substantially straight at an angle of about 80° to about 100°, preferably substantially normal, to the inserting and withdrawing directions IWD. The locking surface 35 is engageable with the front end surface of the recess 13 of the female terminal fitting 10.

Figure 5:
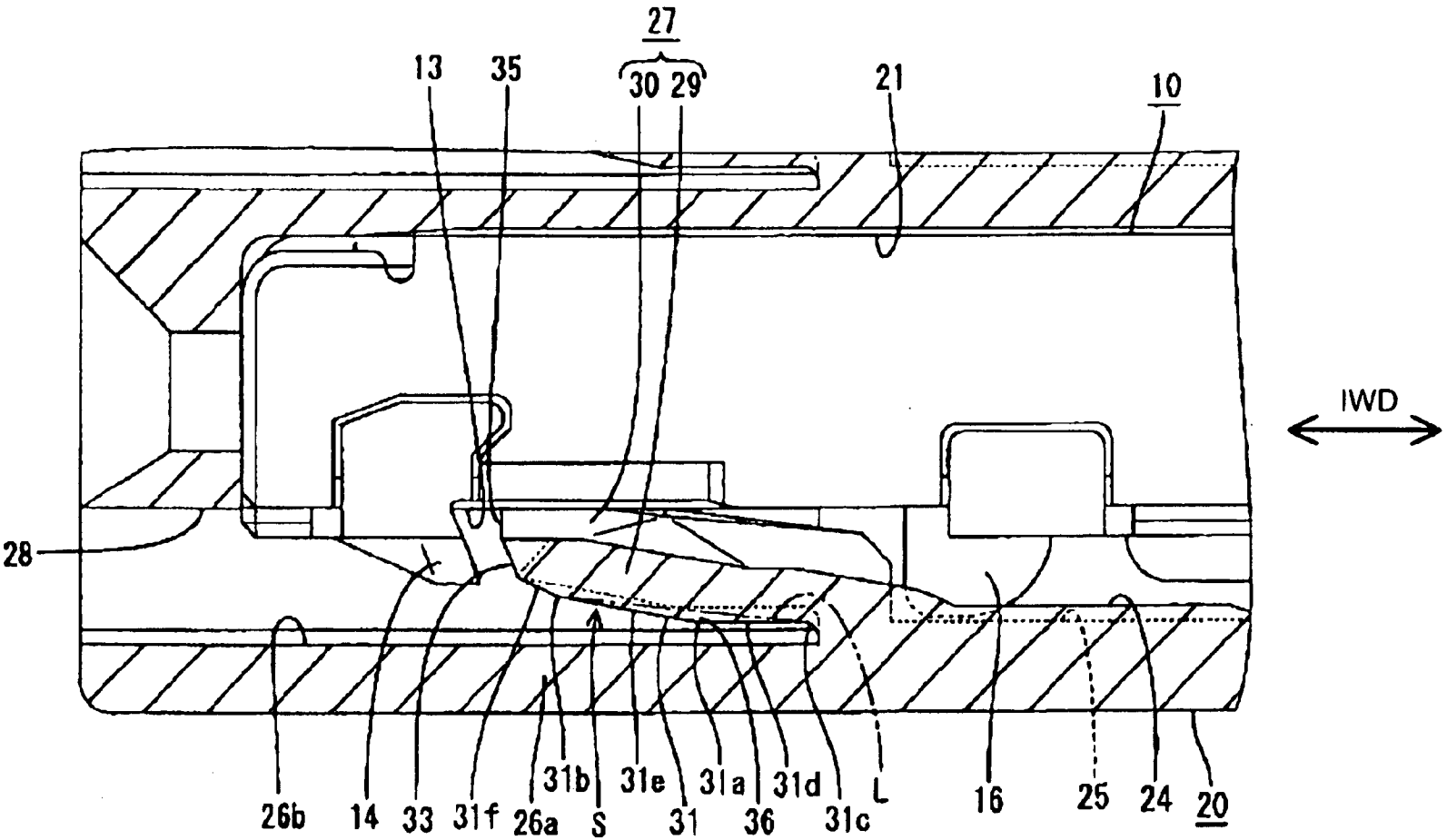
FIG. 5 is an enlarged side view in section showing a state where the female terminal fitting is inserted to a proper depth.

As shown in FIG. 5, the lower surface 31 of the base 29 is stepped twice at intermediate longitudinal positions along the inserting and withdrawal directions IWD. More particularly, the lower surface 29 of the base 29 has steps 31*a* and 31*b* spaced forward from the deformation support 31*c*. The steps 31*a* and 31*b* divide the lower surface 29 of the base 29 into a rear surface 31*d*, a middle surface 31*e* and a front surface 31*f*. The rear surface 31*d* extends horizontally forward from the deformation support 31*c* substantially parallel to the inserting and withdrawal directions IWD along a range of more than about a quarter and preferably about one third of the entire length of the lower surface 31 of the base 29. A clearance of a specified height is defined between the horizontal rear surface 31*d* and a bottom surface 26*b* of the lower part 26*a* of the bottom wall 26. The height of the clearance ensures a suitable strength for pins of the forming mold that are removed forward through the clearance to mold the female housing 20.

The middle surface 31*e* extends forward from the rear step 31*a* for range of more than about a quarter and preferably about one half of the entire length of the lower surface 31 of the base 29. Additionally, the middle surface 31*e* slants up and in relative to the horizontal rear surface 31*d* at an angle substantially equal to an angle of inclination of the lock 27 when the lock 27 is not deformed. However, the middle surface 31*e* is aligned substantially horizontally along the inserting and withdrawal directions IWD and substantially contacts the bottom surface 26*b* of the lowered part 26*a* of the bottom wall 26 when the lock 27 is deformed maximally in the deforming direction DD (see FIG. 6). The front 31*f* of the lower surface 31 of the base 29 extends forward from the front step 31*b*. Additionally, the front surface 31*f* slants up and in at a steeper inclination than the middle surface 31*e*. The upper end of the front slanted surface 31*f* is continuous with both the locking surface 35 and the bottom surfaces of the maneuverable recesses 34. The front slanted surface 31*f* does not contact the bottom surface 26*b* of the lowered part 26*a* of the bottom wall 26 even when the lock 27 is deformed maximally. Thus, a specified clearance is defined between the front slanted surface 31*f* and the bottom wall 26 (see FIG. 6). The bottom surface 26*b* of the lowered part 26*a* of the bottom wall 26 facing the lower surface 31 of the base 29 is substantially parallel to the horizontal surface 31*d* over substantially the entire length with respect to the inserting and withdrawal directions IWD.

The front step 31*b* of the lower surface 31 of the base 29 is at a bottommost position with respect to a deforming direction DD when the lock 27 is deformed maximally. A reinforcement 36 bulges down from the base 29 in the deformation direction DD and towards the deformation space S. More particularly, the reinforcement 36 bulges below the straight phantom line L that connects the front step 31*b* and the deformation support 31*c*. The space between the phantom line L and the bottom surface 26*b* of the lowered part 26*a* of the bottom wall 26 would be dead space if the lower surface 31 of the base 29 extended along the phantom line L. Thus, the reinforcement 36 takes advantage of the dead space. The reinforcement 36 is thickest substantially at the rear step 31*a*, which corresponds to a buckling expected position where the buckling deformation of the lock 27 is expected to occur. The sectional area of the lock 27 is at its maximum when the lock 27 is cut at this position in a direction normal to the longitudinal direction thereof. The buckling expected position can be determined by conducting a test in which the lock 27 is actually caused to undergo a buckling deformation. The reinforcement 36 bulges to substantially the same position as the leading end position of the lock 27 with respect to the deforming direction DD when the locking 27 is maximally resiliently deformed (see FIG. 6).

A substantially widthwise middle of the lower surface 31 of the base 29 has a convex arcuate cross section along the widthwise direction when viewed from front and bulges down over the substantially entire length as shown in FIG. 1. Opposite widthwise sides of the bottom surface 31 are substantially straight along the widthwise direction over substantially the entire length when viewed from front. The bottom surface 26*b* of the lowered portion 26*a* of the bottom wall 26 facing the lower surface 31 of the base 29 is shaped similar to the lower surface 31 of the base 29.

As shown in FIG. 1, the base 29 of the lock 27 is wider than the projection 30. Specifically, the width of the base 29 substantially equal or slightly exceeds the width of the cavity 21. However, the projection 30 is slightly narrower than the cavity 21. Grooves 37, 38 are formed in the opposite side walls of the cavity 21 to form the lock 27. The grooves 37, 38 have open front and rear ends and are formed by removing pins of the molding for forming the locks 27 during molding the female housing 20. Accordingly, the pins of the mold can be made thicker by as much as the depth of the grooves 37, 38, thereby ensuring sufficient strength for the pins. Further, the lock 27 is wider by as much as the depths of the grooves 37, 38, and a sectional area obtained by cutting the lock 27 normal to the longitudinal direction of the lock 27 is increased, thereby increasing the buckling strength of the lock 27.

Figure 4:
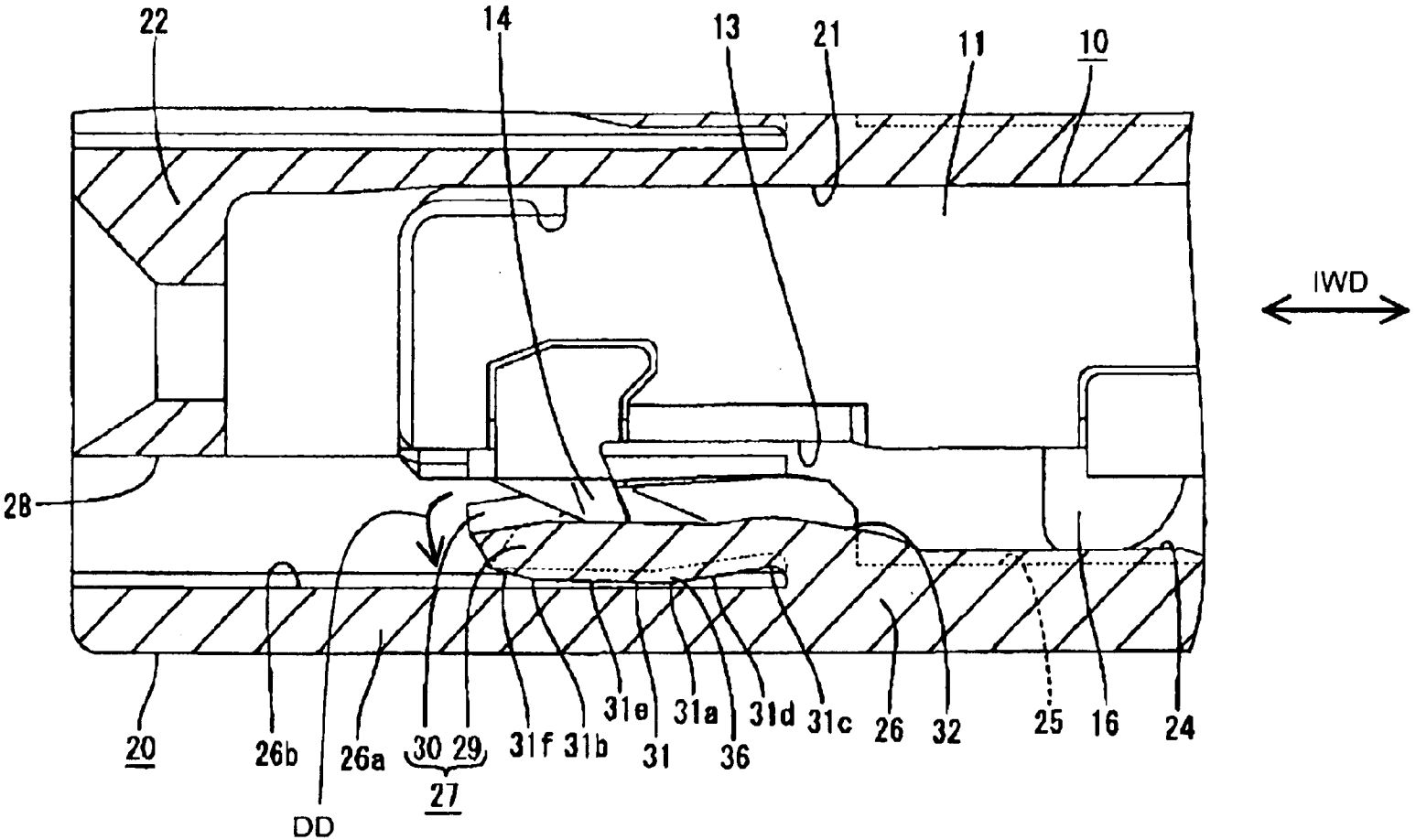
FIG. 4 is an enlarged side view in section showing an intermediate state of the insertion of the female terminal fitting.

The female terminal fitting 10 is connected with the end of the wire W and is inserted into the cavity 21 from behind along the inserting and withdrawing directions IWD. As a result, the locking protrusion 14 and the protrusion 15 enter the protrusion-insertion groove 24 and the stabilizer 16 enter the stabilizer-insertion groove 25 to guide the insertion of the female terminal fitting 10. The lock 27 is pressed down by the locking protrusion 14 when the female terminal fitting 10 is inserted to a specified depth, as shown in FIG. 4. Thus, the lock 27 deforms resiliently in the deformation direction DD. The locking protrusion 14 moves over the lock 27 when the female terminal fitting 10 is inserted substantially to a proper depth in the cavity 21, and the lock 27 is restored resiliently in a direction opposite the deformation direction DD. Consequently, the lock 27 engages the female terminal fitting 10 and enters the recess 13, as shown in FIG. 5. At this time, the locking surface 33 of the lock 27 engages the rear end surface of the locking protrusion 14, whereas the locking surface 35 thereof engages the front end surface of the recess 13. The female housing 20 is connected with the unillustrated mating male housing after the insertion of all the female terminal fittings 10 is completed.

A force could be exerted on the wire W to pull the locked female terminal fitting 10 backward. This force acts on the lock 27 in a direction opposite from the deforming direction DD, and creates a possibility that the lock 27 will buckle. However, the lock 27 has the reinforcement 36 and is wider than the cavity 21. Accordingly the buckling strength is increased and the female terminal fitting 10 is held strongly.

Figure 6:
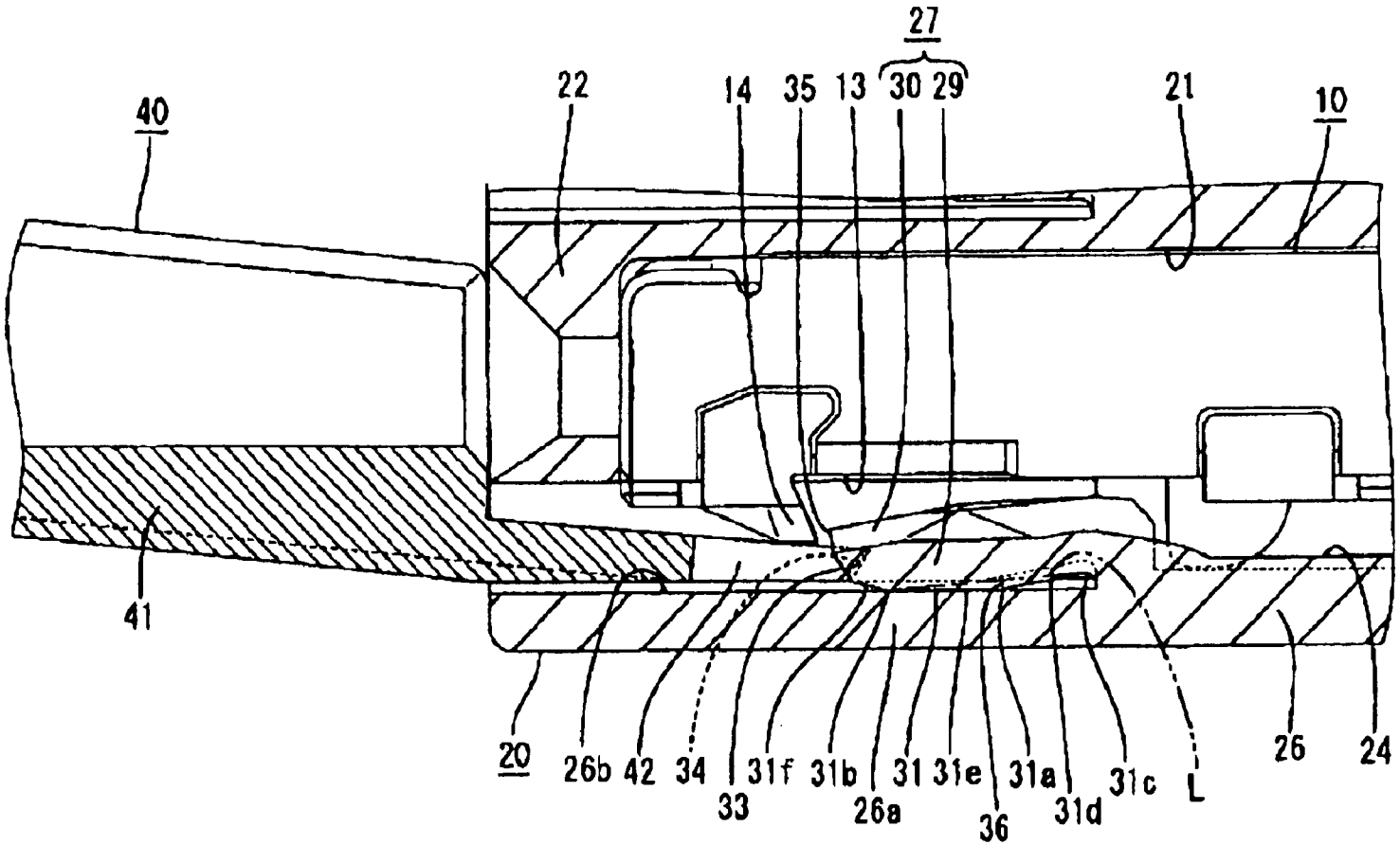
FIG. 6 is an enlarged side view showing a state where a locking portion is resiliently deformed by a jig.

The female terminal fitting 10 may have to be withdrawn for maintenance. In this situation, the maneuverable portions 42 of the jig 40 are inserted into the mold-removal hole 28 of the lock 27 from the front. The jig 40 then is pivoted up to a position where the front-end surface of the grip 41 substantially contacts the front-end surface of the female housing 20. As a result, the lock 27 is deformed resiliently down in the deformation direction DD as shown in FIG. 6. In this state, the female terminal fitting 10 is completely freed from its locked state and can be withdrawn from the cavity 21 by pulling the wire W back while holding the jig 40 in the above posture.

As described above, the lock 27 has the reinforcement 36. Thus, a sectional area obtained by cutting the lock 27 normal to the longitudinal direction of the lock 27 is increased by as much as the reinforcement 36, as compared to a case where the lower surface 31 of the base 29 is straight along the phantom line L. As a result, the buckling strength of the lock 27 is enhanced. Further, the reinforcement 36 bulges towards the deformation space S from the phantom line L connecting the deformation support 31*c* and the front step 31*b*, which leads of the lock 27 in the deforming direction DD when the lock 27 is deformed maximally. Accordingly, the reinforcement 36 uses dead space and the connector is suited for miniaturization.

Further, the reinforcement 36 is thickest at or near the rear step 31*a*, which is the buckling expected position of the lock 27. Thus, the buckling strength can be enhanced further.

The invention is not limited to the above described embodiment. For example, the following embodiments also are embraced by the invention defined by the claims. Various other changes can be made without departing from the scope of the invention as defined by the claims.

The shape of the reinforcement can be changed. For example, the reinforcement may be formed to retract from the leading end of the lock with respect to the deforming direction when the lock is maximally resiliently deformed or may be formed only in a widthwise middle portion of the lock or only in a widthwise side portion of the lock. Alternatively or additionally, the reinforcement may be arcuate or may have two or more portions projecting toward the deformation space S from the phantom line L that connects the front step 31*b* and the deformation support 31*c*.

Although the width of the lock differs between the base portion and the projecting portion in the foregoing embodiment, the invention is also applicable to locks whose widths are substantially constant over the entire height range and locking portions having different shapes.

Although female connector with the female terminal fittings is illustrated in the foregoing embodiment, the invention also is applicable male connectors with male terminal fittings.

Although the lock is illustrated in the foregoing embodiment is cantilevered, it may have a bridge-like shape supported at front and rear ends.

What is claimed is:

1. A connector comprising a housing having opposite front and rear ends, at least one cavity extending between the front and rear ends along an inserting and withdrawing direction, at least one lock cantilevered forward in the housing from a deformation support so that said lock is resiliently deformable relative to the deformation support along a deforming direction substantially normal to the inserting and withdrawing direction, a deformation space on a side of the lock opposite the cavity for accommodating deformation of the lock in the deforming direction, the deformation space being defined between a wall and the lock, the wall being substantially parallel to the inserting and withdrawing direction, the lock having a surface facing the wall, the surface including a rear section extending forward from the deformation support substantially parallel to the inserting and withdrawing direction when the lock is not deformed, a middle section extending forward from the rear section and sloped away from the wall when the lock is not deformed and a front section extending forward from the middle section and sloped more steeply than the middle surface away from the wall of the deformation space such that a reinfocement bulges from the surface of the lock and towards the wall, the reinforcement extending from the deformation support to an intersection of the front and middle sections of the surface of the lock, the reinforcement being configured so that a cross-sectional area of the lock normal to the inserting and withdrawing direction is greater at the intersection of the middle and rear sections of the surface of the lock than at other locations on the lock and so that the middle section substantially abuts the wall when the lock is deformed a predetermined maximum amount in the deforming direction for preventing deformation of the lock beyond its resiliency limit, the intersection of the middle and rear sections of the surface of the lock being forward of the support by a distance between ¼ and ⅓ a total length of the lock.

2. The connector of claim 1, wherein the reinforcement is configured so that the lock has a maximum cross-sect onal area normal to the inserting and withdrawing direction at a location on the lock empirically determined to be most likely to buckle in response to forces on the lock towards the rear end of the housing.

3. The connector of claim 2, wherein the lock has a base adjacent the deformation space and a projection adjacent the cavity, the base being wider than the projection.

4. The connector of claim 3, wherein the base is at least as wide as the cavity and the projection is narrower than the cavity.

5. The connector of claim 1, wherein the lock has a protrusion-insertion groove for receiving a protrusion of the terminal fitting during insertion of the terminal fitting into the cavity.

6. The connector of claim 5, wherein a bulge projects into the cavity at a portion of the deformation support of the lock that includes the protrusion-insertion groove, thereby reinforcing the lock.

7. The connector of claim 1, wherein the housing comprises at least one forwardly open mold-removal hole in a front wall of the cavity in a position in front of the lock.

8. The connector of claim 1, wherein the front section does not contact a wall of the housing even when the lock is deformed maximally, whereby a specified clearance is defined between the front section and the wall.

9. A connector comprising g a housing having opposite front and rear ends, a cavity extending between the front and rear ends along inserting and withdrawing directions, a lock cantilevered forwardly into he cavity from a support and being resiliently deformable along a deforming direction substantially normal to the inserting and withdrawing direction, a deformation space on a side of the lock opposite the cavity for accommodating sufficient deformation of the lock in the deforming direction for permitting insertion of a terminal fitting into the cavity, a wall opposed to the lock so that the deformation space is between the wall and the lock, the wall being substantially parallel to the inserting and withdrawing direction, the lock having a surface facing the wall, the surface having a rear section substantially parallel to the wall when the lock is unbiased and an intermediate section aligned at an acute angle to the wall when the lock is unbiased, the intermediate section substantially abutting the wall when the lock is deformed in the deforming direction an amount required for inserting the terminal fitting into the cavity and for preventing deformation of the lock beyond its resiliency limit, wherein the rear section and the intermediate section meet at a step, disposed forward from the support a distance approximately equal to between ¼ and ⅓ of a total length of the lock and before the lock is deformed beyond its resiliency limit for preventing an excessive deformation of the lock, cross sectional areas of the lock normal to the inserting and withdrawing direction defining a maximum at the step.

10. The connector of claim 9, wherein the intermediate section extends forward from the rear section a distance approximately equal to between ¼ and ½ of the total length of the lock.

11. The connector of claim 10, wherein the step is at a location on the lock determined to be most susceptible to buckling.

12. The connector of claim 9, wherein the lock has a base adjacent the deformation space and a projection adjacent the cavity, the base being wider than the projection.

13. The connector of claim 12, wherein the base is at least as wide as the cavity and the projection is narrower than the cavity.

* * * * *